United States Patent [19]

Vander Hoek et al.

[11] 4,171,789

[45] Oct. 23, 1979

[54] HANGER BRACKET LOCK

[75] Inventors: Harold Vander Hoek, Grand Rapids; Gale Wilcox, Middleville, both of Mich.

[73] Assignee: Steelcase Inc., Grand Rapids, Mich.

[21] Appl. No.: 899,486

[22] Filed: Apr. 24, 1978

[51] Int. Cl.[2] ..... A47G 29/02

[52] U.S. Cl. ..... 248/243; 108/108; 211/192

[58] Field of Search ..... 248/243, 222.1, 223.1; 108/108, 109, 110; 211/187, 191, 192; 292/175; 403/27; 52/36

[56] References Cited

U.S. PATENT DOCUMENTS

| | | | |
|---|---|---|---|
| 517,503 | 4/1894 | Wenker | 108/108 |
| 2,547,315 | 4/1951 | Gray | 292/175 |
| 3,168,365 | 2/1965 | Evans | 108/109 X |
| 3,273,847 | 9/1966 | Berman | 248/243 |
| 3,299,839 | 1/1967 | Nordbak | 248/243 X |
| 3,351,212 | 11/1967 | McConnell | 211/187 X |
| 3,730,108 | 5/1973 | Stroh | 248/243 X |
| 3,881,829 | 5/1975 | James | 403/27 |
| 3,966,158 | 6/1976 | Bounoy | 248/243 |
| 4,013,254 | 3/1977 | Bounoy | 248/243 |

*Primary Examiner*—J. Franklin Foss

*Attorney, Agent, or Firm*—Price, Heneveld, Huizenga & Cooper

[57] ABSTRACT

The specification discloses a furniture system in which a furniture unit is hung on a support by means of hooks which hook into apertures in the support, the unit being locked in place by a lock which is biased into engagement with one of the apertures in the support. The lock and furniture unit in which it is mounted include a detent system which holds the lock in an unlocked position when engaged, enabling one to remove the furniture unit from the support without having to simultaneously manually hold the lock in an unlocked position. The lock and the support further include an automatic release system which automatically releases the detent when the unit is first hooked into the support whereby the lock automatically snaps into its locked condition.

25 Claims, 6 Drawing Figures

HANGER BRACKET LOCK

BACKGROUND OF THE INVENTION

The present invention relates to furniture systems in which a furniture unit such as a work surface or cabinet is hung on some type of support. Typical supports comprise slotted standards. The furniture unit includes hooks which hook into the slots to hold the unit in position on the slotted standards.

To keep the unit from being inadvertently bumped upwardly and thereby cause the hooks to disengage the slots and the unit to fall to the floor, manufacturers sometimes provide the furniture unit with a lock which locks the unit in position on the support. The lock is typically biased toward engagement with another slot in the slotted standard. Thus, as one lifts the unit to its position and hooks the hooks into their receiving slots, the lock is biased into position in engagement with another slot.

The problem with such systems is that once the unit is mounted and locked into place, it is extremely difficult to move the unit to another position or to another support. The furniture units themselves are typically heavy. It is extremely difficult for a single person to pull back on the lock, hold it in an unlocked condition, and simultaneously lift the furniture unit up and pull it out away from the support. The lifting and then outward motions are required in order to disengage the hooks from the slots.

As a result, the use of locks in such systems actually tends to detract from the mobility for which the systems are designed in the first place.

SUMMARY OF THE INVENTION

In the present invention, these difficulties are obviated by providing the lock with a detent means which can be positioned in engagement with a detent engaging means on the furniture. When the lock is positioned with its detent engaged, it is held in an unlocked condition. Thus, a user can move the lock to its unlocked position and can rely on the detent system to hold the lock in its unlocked position while he lifts the furniture unit up and outwardly away from the support to thereby disengage the hooks from their receiving apertures.

These and other objects, advantages and further features of the invention will be more fully understood and appreciated by reference to the written specification and appended drawings.

DESCRIPTION OF THE PREFERRED EMBODIMENT

Figure 1:
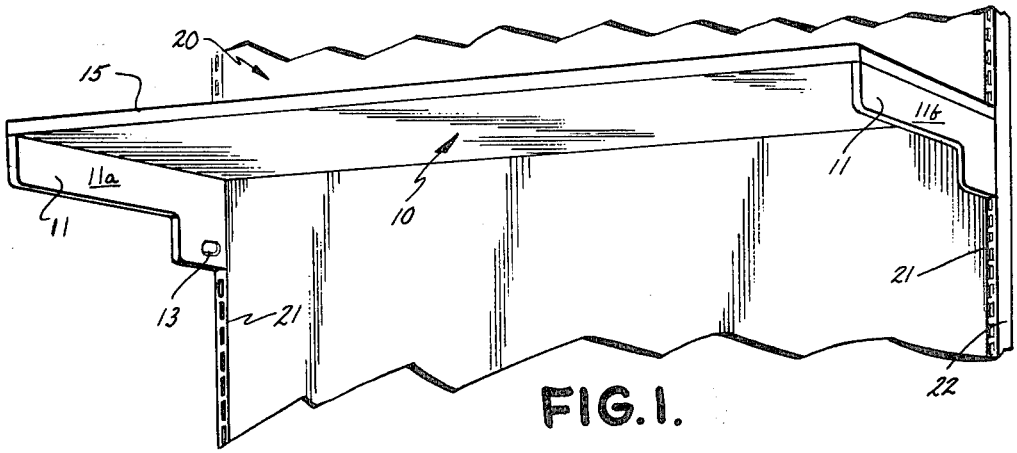
FIG. 1 is a perspective view looking generally at the bottom of the furniture unit hung on a support panel.
Figure 4:
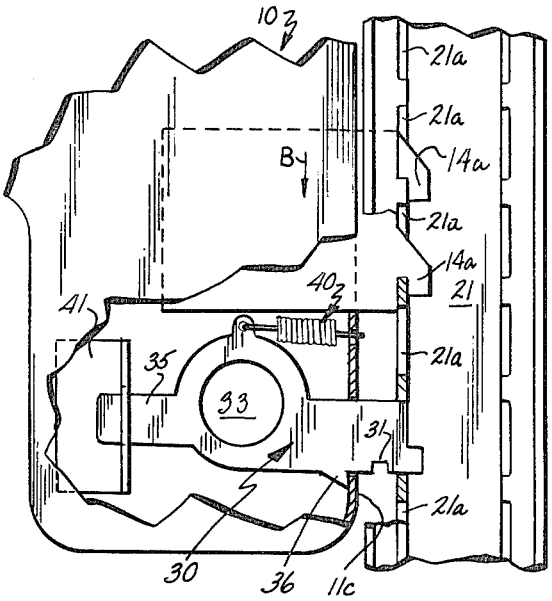
FIG. 4 is basically the same view as FIG. 3, but after the furniture unit has been moved in a downward motion as indicated by the arrow B so that the hooks now hook into their receiving slots and the furniture unit is firmly hung on its support panel.
Figure 5:
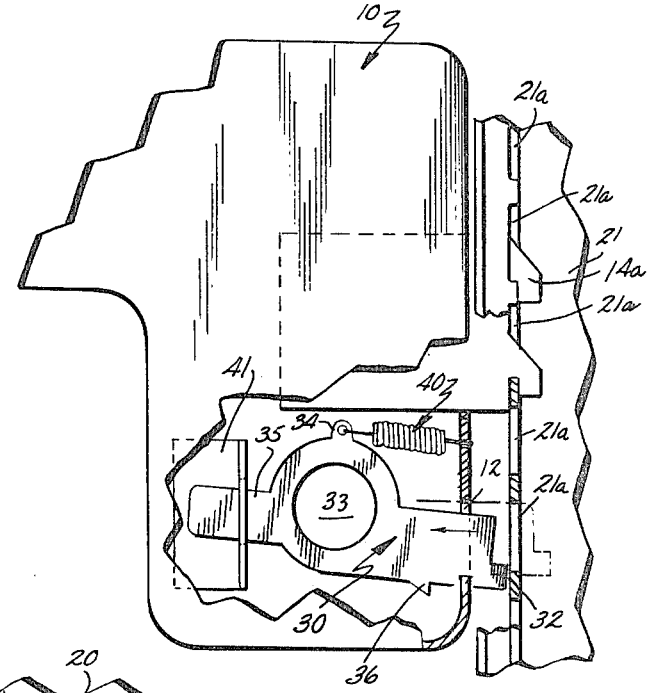
FIG. 5 is basically the same view as FIGS. 3 and 4, except that the lock has been moved into an unlocked position whereby the furniture unit can now be lifted up and moved outwardly away from its support.

As shown in FIG. 1, furniture unit 10 is locked in position hung on support panel 20. FIG. 4 illustrates the locking action, showing lock 30 which is biased by spring 40 into engagement with an aperture **21*a* in a slotted standard 21 which comprises a component of support panel 20. By reaching through access opening 13 in furniture unit 10 (FIG. 1), one can insert his finger into the finger hole 33 in lock 30 and retract it until a detent notch 31 is seated over an edge of that portion of the furniture unit wall which surrounds the lock opening 12 (FIG. 5). In this position, lock 30 is in an unlocked position and furniture unit 10 can be removed from support 20. As one moves the furniture unit 10 back into position in the direction of arrow A in FIG. 3, the end of lock 30 automatically projects into an aperture 21*a* as shown in FIG. 3, and as one then pushes the furniture unit 10 downwardly as shown in arrow B in FIG. 4, detent notch 31 disengages and lock 30 snaps into its locked position within a notch 21*a*** as shown in FIG. 4.

Furniture unit 10 can be any of a variety of different units. Typically, it will be a work surface as shown in FIG. 1, or a cabinet of some sort or a shelf. Unit 10 as shown includes a pair of end bells 11, as they are often referred to in the art, secured to a top 15 (FIG. 1). End bell 11 includes an inside wall **11*a*, an outside wall 11*b* and an edge wall joining the two. At the rear of bell 11, edge wall defines a back wall 11*c* which is most pertinent to the discussion of the present invention since back wall 11*c* is positioned against support 20 when furniture unit 10** is hung in place (see FIGS. 1–3).

Figure 2:
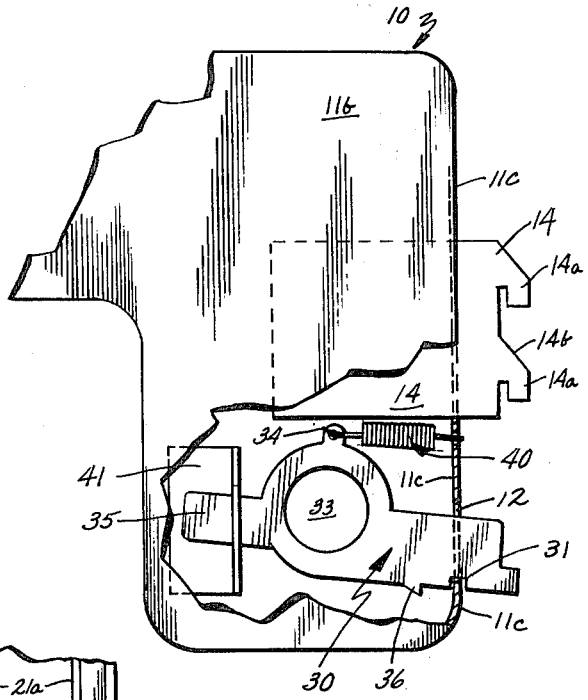
FIG. 2 is a fragmentary end view of the furniture unit with a sufficient amount of the end wall of the unit broken away to allow viewing of the lock made in accordance with the preferred embodiment of the present invention.
Figure 3:
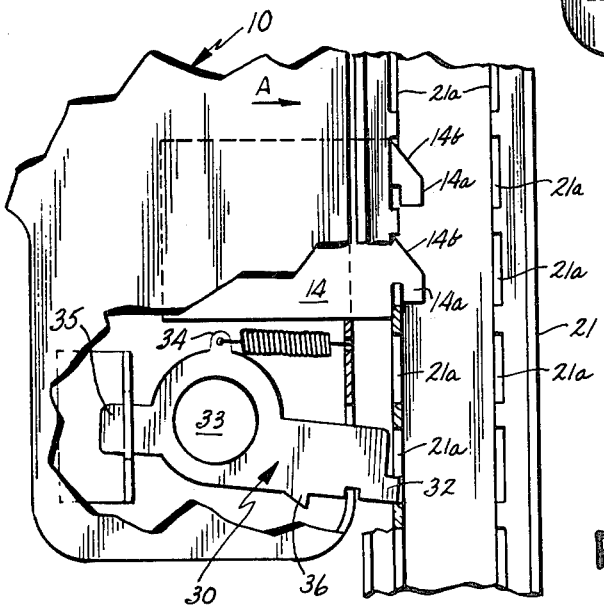
FIG. 3 is the same view of the furniture unit as is shown in FIG. 2, with the unit being shown just as the hooks on the unit are being positioned within the apertures in the slotted support standards on the support panel, and before the furniture unit has been moved downwardly to positively engage the hooks within their receiving slots.

There is a lock opening 12 in back wall **11*c* through which lock 30 projects (FIGS. 1–3). There is an access opening 13 on the inside wall 11*a* of each end bell 11 through which one can extend his finger for insertion into finger hole 33 in lock 30** (FIG. 1).

Furniture unit 10 includes a hanger bracket 14 rigidly secured in each end bell 11. Hanger bracket 14 includes projecting hooks **14*a* for hooking into slots 21*a* in the slotted standards 21. Such hooked brackets and slotted standards are typical of furniture systems of this type, but it is conceivable that the present invention could be used in connection with other approaches to hanging the furniture unit 10 on support panel 20**.

Support panel 20 is conventional, including a slotted standard 21 at each end edge (FIG. 1). There is usually a cover 22 over each end of support panel 20, but the cover is shown removed in FIGS. 3–6 herein.

Figure 6:
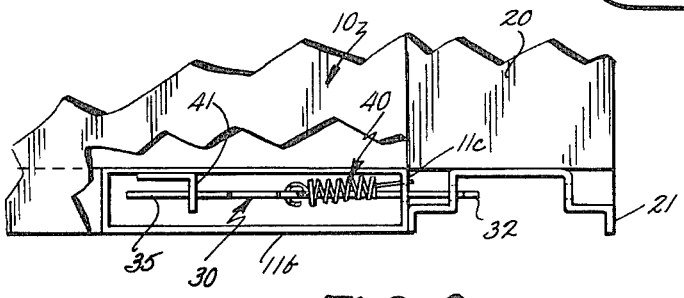
FIG. 6 is a top plan view of an end portion of the support panel and furniture unit with a portion broken away to show the lock made in accordance with the preferred embodiment of the present invention.

Lock 30 is preferably stamped from a piece of sheet metal. It is positioned within the cavity defined by the spaced side walls **11*a* and 11*b* of end bell 11 (FIGS. 2 and 6). It includes a detent notch 31 cut out of the lower edge thereof (FIGS. 2–5). Lock 30 also includes a projecting nose 32 which defines the extreme end of lock 30 in the direction of slotted standard 21. The dimensional relationship of the shape and location of notch 31 to the end of lock 30 as defined by nose 32 and to the bottom edge of opening 12 in back wall 11***c* of end bell 11 is important to achieving all of the advantages of the preferred embodiment of the invention.

Specifically, notch 31 must be wider from one side edge to the other than the width of the wall 11*c* at the bottom edge of aperture 12. Further, it must be sufficiently wide, and must be located relative to the end of projecting nose 32, such that when the forward edge of notch 31 is resting against back wall 11*c* as shown in FIG. 3, at least a portion of the end of lock 30, specifically of nose 32, extends into a slot 21*a* and is engaged by the bottom edge thereof, all as shown in FIG. 3. Yet, notch 31 must be sufficiently wide and sufficiently deep that lock 33 can be retracted slightly and allowed to drop down so that the end of nose 32 abuts against the slotted support standard 21, specifically against the bridge of metal between adjacent slots 21*a*, all as best shown in FIG. 5. It will be noted that in FIG. 5, neither the front nor rear edges of notch 31 are actually abutting against wall 11*c*, but the top edge of notch 31 is abutting against the edge of lock opening 12. Thus, the detent notch 31 and the edge of opening 12 might be said to be loosely engaged. In contrast in FIG. 3, it will be noted that the forward edge of notch 31 is abutting against wall 11*c*, but neither the top edge nor the back edge of notch 31 is abutting any portion of wall 11*c*.

Because of this play or loose fit between detent notch 31 and that portion of wall 11*c* which engages detent notch 31, lock 30 will tend to slide into a receiving slot 21*a* as furniture unit 10 is first pushed rearwardly into position into slotted standard 21 as shown in FIG. 3, thereby facilitating automatic release of detent notch 31 and injection of lock 30 into slot 21*a* as shown in FIG. 4, yet due to the aforesaid play, lock 30 can actually be completely withdrawn from slot 21*a* when furniture unit 10 is in its at rest position as shown in FIG. 5, and slipped downwardly slightly so that the end of nose 32 abuts against a bridge of metal between adjacent slots 21*a*, thereby facilitating the removal of furniture unit 10 from support 20 (FIG. 5).

Lock 30 also includes a small projecting spring mount 34 at the top thereof with a hole therein for receiving one end of a bias spring 40. Spring 40 extends from spring mount 34 and is hooked through a hole in wall 11*c* at a point such that spring 40 is inclined downwardly slightly as one proceeds from the front of unit 10 towards the rear thereof in the direction of slotted standard 21. Because of this relationship, lock 30 is biased not only rearwardly towards engagement with a slot 21*a*, but is also biased slightly downwardly to facilitate engagement of detent notch 31 with the bottom edge of wall 11*c* adjacent lock opening 12.

Generally, the width of lock 30 from top to bottom, especially near the rear end thereof where it extends through a slot 21*a*, is approximately the same as the height of a slot 21*a* from its bottom edge to its top edge. This insures a snug lock, as indicated in FIG. 4. Preferably, projecting nose 32 is narrower in width from top to bottom than slot 21*a* is high from top to bottom. This makes it easier to get lock 30 started when one is first mounting furniture unit 10 on slotted standard 21 as indicated in FIG. 3.

Lock 30 includes a guide tab 35 which projects forwardly therefrom in a direction away from slotted standard 21. Guide flange 35 projects through a slot in a guide bracket 41 mounted on the inside of wall 11*a* within the cavity defined by end bell 11 (see FIGS. 2–6). A slot in guide bracket 41 loosely holds guide tab 35 and allows lock 30 to be moved about readily either through manual operation or through the biasing of spring 40.

Lock 30 includes a downwardly projecting limit stop 36 which comes to rest against wall 11*c* adjacent opening 12 when lock 30 is in its locking position as shown in FIG. 4. Stop 36 prevents spring 40 from biasing lock 30 even further and thereby serves as a limit stop.

In operation, one would begin to mount furniture unit 10 on panel 20 by lifting furniture unit 10 and moving it in a generally horizontal direction as indicated by arrow A in FIG. 3 until hooks 14*a* project through slots 21*a*. This results simultaneously in the end of projecting nose 32 projecting a short distance into slot 21*a*. In this regard, it is preferable that the leading upper edges 14*b* of hooks 14*a* be inclined downwardly as one proceeds rearwardly so that if the end of nose 32 hangs up in any way against the bridge of metal between adjacent slots 21*a*, one can simply lift furniture unit 10 slightly since the inclined edge 14*b* allows this and the nose 32 will then tend to snap forwardly just a short distance into its slot 21*a*.

Once furniture unit 10 is in the position shown in FIG. 3, it can then be lowered in a vertically downward direction as indicated by arrow B in FIG. 4. As a result, detent notch 31 will ride up off of that portion of back wall 11*c* which engages it and will be biased rearwardly by bias spring 40 such that it snaps completely into the space defined by its receiving slot 21*a*, as shown in FIG. 4. Furniture unit 10 is now locked in place on support panel 20.

During the mounting operation, lock 30 can be in a locked or unlocked position. Either way, it will snap into locking engagement with slot 21*a* when hooks 14*a* are lowered "home".

To facilitate removal, one reaches into access opening 13 in end bell 11 and engages finger hole 33 with his finger, pulling the lock 30 rearwardly until it is completely without slot 21*a*. As one does this, the action of biasing spring 40 will tend to force lock 30 in a slightly downward movement so that notch 31 snaps down over the bottom edge of lock opening 12 and the end of nose 32 snaps down into abutment against the bridge between adjacent slots 21*a*, all as shown in FIG. 5. This biasing action is enhanced somewhat by the fact that finger hole 33 is perfectly round so that lock 30 tends to rotate about the finger through the action of bias spring 40, rather than tending to lock against any movement relative to the finger.

Furniture unit 10 can then readily be lifted up and moved outwardly relative to slotted standards 21 to thereby remove it from support panel 20.

Of course, it is understood that the above is merely a preferred embodiment of the invention and that various changes and alterations can be made without departing from the spirit and broader aspects of the invention as further defined in the appended claims.

The embodiments of the invention in which an exclusive property or privilege is claimed are defined as follows:

1. In a furniture system including a furniture unit releasably mounted on a support by means of hooks projecting from said furniture unit and hooking into apertures in said support, and including a biased lock movably mounted on said furniture unit and being biased towards engagement with another aperture in said support whereby said hooks cannot be removed from said apertures when said lock is in its locked position and in engagement with said other aperture, the improvement comprising: detent means on said lock and detent engaging means on said furniture unit positioned to engage said detent means when said lock is fully removed from said aperture to its unlocking position, whereby said lock can be moved to said unlocked position and will be held in said unlocked position out of engagement with said other aperture without requiring a user to manually hold said lock in said unlocked position.

2. The furniture system of claim 1 in which said lock includes automatic release means for moving said detent means out of engagement with said detent engaging means, and said support includes a release engaging means positioned to engage and activate said automatic release means when said furniture unit is located with said hooks hooked into said apertures whereby said lock will automatically move into engagement with said other aperture and lock said furniture unit in place on said support.

3. The furniture system of claim 2 in which said automatic release means and said release engaging means are positioned such that when said detent is engaged by said detent engaging means, and when said furniture unit is positioned with said hooks located in said apertures but not yet hooked downwardly into said apertures, said automatic release means is aligned with said release engaging means, and such that when said furniture unit is moved so that said hooks do hook downwardly into said apertures, said release engaging means engages and activates said automatic release means to disengage said detent means and cause said lock to be biased into engagement with said other aperture.

4. The furniture system of claim 3 in which said detent means and said detent engaging means are adapted so that there is play in the engagement thereof, whereby when said furniture unit is in position with said hooks hooked down into said apertures in said support, said lock can be moved out of said other aperture completely and into a position where it is biased against the surface of said support in the vicinity of and outside of said other aperture and where said detent means and said detent engaging means are at the same time loosely engaged.

5. The furniture system of claim 4 in which said detent means comprises a notch in said lock, said furniture unit including a wall having a lock opening through which said lock projects, said detent engaging means comprising a portion of said wall adjacent said opening which engages said notch when said lock is moved so that said notch fits over said portion of said wall.

6. The furniture system of claim 5 in which said notch is sufficiently deep from top to bottom and sufficiently wide from front to back to facilitate said play whereby at least a portion of said lock will project into said other aperture when the front edge of said notch in a direction away from said support is engaging said wall portion, yet whereby said lock can be shifted forwardly such that it is entirely without said other aperture and such that the end of said lock engages said support in the vicinity of said other aperture while said detent notch is still positioned over and loosely engaged with said wall portion adjacent said lock opening.

7. The furniture system of claim 6 in which said automatic release means on said lock comprises said lock having sufficient length that when it is in its unlocked, detent engaged position, at least an end portion thereof projects into said other aperture, said release engaging means comprising an edge of said other aperture which engages said end projecting portion of said lock and acts against it to move said lock as said hooks are hooked into said apertures whereby said detent disengages said detent engaging means.

8. The furniture system of claim 7 in which said bias means biases said lock not only rearwardly towards engagement with said other aperture, but also slightly downwardly such that said detent is biased towards engagement with said detent engaging means.

9. The furniture system of claim 8 in which said support comprises slotted standards wherein regularly spaced slots serve as apertures to receive said hooks or alternatively as apertures to receive said lock, depending on the relative positioning of said furniture unit on said support.

10. The furniture system of claim 6 in which said bias means biases said lock not only rearwardly towards engagement with said other aperture, but also slightly downwardly such that said detent is biased towards engagement with said detent engaging means.

11. The furniture system of claim 5 in which said bias means biases said lock not only rearwardly towards engagement with said other aperture, but also slightly downwardly such that said detent is biased towards engagement with said detent engaging means.

12. The furniture system of claim 3 in which said automatic release means on said lock comprises said lock having sufficient length that when it is in its unlocked, detent engaged position, at least an end portion thereof projects into said other aperture, said release engaging means comprising an edge of said other aperture which engages said end projecting portion of said lock and acts against it to move said lock as said hooks are hooked into said apertures whereby said detent disengages said detent engaging means.

13. The furniture system of claim 2 in which said automatic release means on said lock comprises said lock having sufficient length that when it is in its unlocked, detent engaged position, at least an end portion thereof projects into said other aperture, said release engaging means comprising an edge of said other aperture which engages said end projecting portion of said lock and acts against it to move said lock as said hooks are hooked into said apertures whereby said detent disengages said detent engaging means.

14. In a furniture system including a furniture unit releasably mounted on a support by means of hooks projecting from said furniture unit and hooking into apertures in said support, and including a biased lock movably mounted on said furniture unit and being biased towards engagement with another aperture in said support whereby said hooks cannot be removed from said apertures when said lock is in its locked position and in engagement with said other aperture, the improvement comprising: said furniture unit including a cavity having a back wall which is adjacent said support; said lock being located within said cavity; a lock opening in said back wall through which said lock projects, said lock being biased to movement through said opening by biasing means located within said cavity; said lock including a detent notch in the bottom edge thereof, said detent notch having a width from the front edge thereof to the back edge thereof and a height and a distance from the end of said lock such that at least a portion of said lock will project into said other aperture when the front edge of said notch, in a direction away from said support, is engaging said wall portion, yet whereby said lock can be shifted forwardly such that it is entirely without said other aperture and such that the end of said lock engages said support in the vicinity of said other aperture while said detent notch is still positioned over and loosely engaged with said wall portion adjacent said lock opening.

15. The furniture system of claim 14 wherein that portion of said lock which is located within said other aperture when said lock is in its locking position is approximately the same in width from top to bottom as the height of said other aperture from top to bottom whereby said furniture unit is positively locked in place; said lock including an end projecting rearwardly therefrom which is smaller than the adjacent body of said lock whereby said projecting end can be easily inserted into said other aperture initially during the initial positioning of said furniture unit on said support means.

16. The furniture system of claim 15 in which said bias means biases said lock not only rearwardly towards engagement with said other aperture, but also slightly downwardly such that said detent is biased towards engagement with said detent engaging means.

17. The furniture system of claim 16 in which said bias means is secured at one end to the top of said lock and secured at the other end of said back wall of said furniture unit and is inclined downwardly in a rearward direction towards said support whereby said lock is biased not only rearwardly towards said support, but also slightly downwardly to thereby bias said notch towards engagement with said notch engaging wall portion of said back wall.

18. The furniture system of claim 17 in which said lock includes a round hole therein through which one's finger can be inserted, said round hole facilitating pivotal movement of said lock about said finger whereby as one draws said lock out of said other aperture, it tends to rotate about one's finger such that said detent notch moves downwardly over said detent engaging wall portion adjacent said lock opening.

19. The furniture system of claim 18 in which said hooks include leading rear edges which are inclined downwardly as one proceeds rearwardly towards said support whereby said furniture unit can be moved up and down slightly during initial mounting without completely disengaging said hooks from said aperture.

20. The furniture system of claim 19 in which said lock includes a tab on the front thereof away from said support and said cavity includes a guide means positioned such that said tab extends into said guide means whereby movement of said lock is guided thereby.

21. The furniture system of claim 20 in which said furniture unit includes an access opening accessible from the exterior thereof and opening into the interior of said cavity whereby one can reach through said access opening and grasp said lock.

22. The furniture system of claim 16 in which said hooks include leading rear edges which are inclined downwardly as one proceeds rearwardly towards said support whereby said furniture unit can be moved up and down slightly during initial mounting without completely disengaging said hooks from said apertures.

23. The furniture system of claim 14 in which said bias means is secured at one end to the top of said lock and secured at the other end of said back wall of said furniture unit and is inclined downwardly in a rearward direction towards said support whereby said lock is biased not only rearwardly towards said support, but also slightly downwardly to thereby bias said notch towards engagement with said notch engaging wall portion of said back wall.

24. The furniture system of claim 23 in which said lock includes a round hole therein through which one's finger can be inserted, said round hold facilitating pivotal movement of said lock about said finger whereby as one draws said lock out of said other aperture, it tends to rotate about one's finger such that said detent notch moves downwardly over said detent engaging wall portion adjacent said lock opening.

25. The furniture system of claim 14 in which said furniture unit includes an access opening accessible from the exterior thereof and opening into the interior of said cavity whereby one can reach through said access opening and grasp said lock.

* * * * *

UNITED STATES PATENT AND TRADEMARK OFFICE

CERTIFICATE OF CORRECTION

PATENT NO. : 4,171,789

DATED : October 23, 1979

INVENTOR(S) : Harold Vanden Hoek and Gale Wilcox

It is certified that error appears in the above-identified patent and that said Letters Patent are hereby corrected as shown below:

Column 8, line 34:

"hold" should be -- hole --.

Inventor's name:

"Vander Hoek" should be --Vanden Hoek--

Signed and Sealed this

*Fifteenth* Day of *July 1980*

[SEAL]

*Attest:*

SIDNEY A. DIAMOND

*Attesting Officer*

*Commissioner of Patents and Trademarks*